US005176003A

United States Patent [19]

Horikawa et al.

[11] Patent Number: 5,176,003

[45] Date of Patent: Jan. 5, 1993

[54] CRYOSTAT

[75] Inventors: Mitsuo Horikawa; Takahiro Matsumoto; Kazuki Moritsu, all of Akou, Japan

[73] Assignee: Mitsubishi Denki Kabushiki Kaisha, Tokyo, Japan

[21] Appl. No.: 755,238

[22] Filed: Sep. 5, 1991

[30] Foreign Application Priority Data

Sep. 5, 1990 [JP] Japan ..... 2-238692
Mar. 6, 1991 [JP] Japan ..... 3-39788

[51] Int. Cl.[5] ..... F25B 19/00

[52] U.S. Cl. ..... 62/51.1; 62/295; 505/892

[58] Field of Search ..... 62/51.1, 295, 45.1; 505/892

[56] References Cited

U.S. PATENT DOCUMENTS 3,230,726 1/1966 Berner et al. ..... 62/45.1
4,502,296 3/1985 Ogata et al. ..... 62/51.1
4,510,771 4/1985 Matsuda et al. ..... 62/51.1

FOREIGN PATENT DOCUMENTS 260036 3/1988 European Pat. Off. .
88378 4/1987 Japan .
185383 8/1987 Japan .
149406 4/1989 Japan .

*Primary Examiner*—Ronald C. Capossela

[57] ABSTRACT

In a cryostat having a vacuum container (6), a refrigerator (2) having an elongated part (2b,2c) extending in the vacuum container and having a cooling section (36, 37), a cooled member (4, 5) cooled by the cooling section, and a thermal coupling member (21, 27) thermally coupling the cooling section (36, 37) with the cooled member (4, 5), the thermal coupling member includes a first thermal contactor (22, 28) thermally coupled to the cooling section, and a second thermal contactor (29) thermally coupled to the cooled member, the first and second contactors mating with each other. The mating surfaces of the first and second contactors are inclined, and one of the first and second contactors is mounted such that it can be moved. A resilient member presses said one of the contactors against the other contactor. The contact pressure at the mating surfaces is thereby kept substantially constant. Partitions may be provided to divide the space within the jacket into parts thereby to reduce heat infiltration by convection. A communication tube may be provided to connect the space within the jacket to a space in which evaporated cryogen gas is staying.

20 Claims, 8 Drawing Sheets

CRYOSTAT

FIELD OF THE INVENTION

The present invention relates to a cryostat for cooling a superconducting magnet used, for example, in a nuclear magnetic resonance (NMR) imaging apparatus.

BACKGROUND OF THE INVENTION

FIG. 1 shows a prior-art cryostat shown, for example, in European Patent Application No. 0,260,036 A2, published Mar. 16, 1688. It comprises a cryogen container 1 accommodating a cooled object, such as coils of a superconducting magnet, not shown, and containing a liquid cryogen, such as a liquid helium kept at a temperature of 4.2 K, with the cooled object being immersed in the liquid cryogen.

The device further comprises a refrigerator 2, a first heat shield 4 comprising walls surrounding the cryogen container 1, a second heat shield 5 comprising walls disposed between the cryogen container 1 and the first heat shield 4 and surrounding the cryogen container 1. The first and the second heat shields 4 and 5 shut off heat radiation from the outside to the cryogen container 1 and conduct heat to the refrigerator 2. The first and the second heat shields 4 and 5 constitute a cooled member 3 to be cooled by the refrigerator 2.

A vacuum container 6 accommodates the cryogen container 1, and the first and second heat shields 4 and 5, and its interior is kept at a vacuum state, thereby to provide a vacuum heat insulation.

The refrigerator 2 has a main block 2*a* situated outside the vacuum container 6, a first elongated, e.g., cylindrical, part 2*b* having a first end (or upper end as seen in FIG. 2) connected to the main block 2*a* and extending from the main block 2*a*, downward as seen in FIG. 1 thereby extending into the vacuum container 6 and having its tip or second end (lower end as seen in FIG. 2) situated near the first heat shield 4, and a second elongated, e.g., cylindrical, part 2*c* of a smaller diameter than the first cylindrical part 2*b* , being coaxial with the first cylindrical part 2*b*, having a first end (upper end as seen in FIG. 2) connected to the second end of the first cylindrical part 2*b*, and extending through an opening 4*a* provided in the first heat shield 4 and having its tip or second end (lower end as seen in FIG. 2) situated near the second heat shield 5.

A flange 7 is provided for mounting the refrigerator 2 to the vacuum container 6. Bellows 8 is provided between the vacuum container 6 and the flange 7 for absorbing any oscillation of the refrigerator 2 thereby preventing the oscillation from being transmitted to the vacuum container 6.

The refrigerator 2 has a first-stage cooling section 9 and a second-stage cooling section 14. The first-stage cooling section 9 is annular and is disposed to encircle the first cylindrical part 2*b*, in the vicinity of the refrigerator 2. The first-stage cooling section 9 comprises a collar part 9*a* having its inner periphery in contact with and fixed to the outer cylindrical surface of the first cylindrical part 2*b*, and a flange part 9*b* having its inner edge connected to the lower edge of the collar part 9*a*.

A first thermal coupling member 10 is flange-shaped and is in contact with the lower surface of the flange part 9*b* of the first-stage cooling section 9 for thermal conduction between them.

A first heat conduction plate 11 is in contact with the first thermal coupling member 10, and a first flexible conductive member 12 is in contact with the first heat conduction plate 11 and also with the first heat shield 4. The first thermal coupling member 10, the first heat conduction plate 11 and the first flexible conductive member 12 together provide thermal coupling between the first-stage cooling section 9 and the first heat shield 4. The first flexible conductive member 12 absorbs any thermal contraction due to temperature change.

A first jacket 13 has a cylindrical part 13*a* which is provided to surround the first-stage cooling section 9 and the first thermal coupling member 10. The first jacket 13 also has a flange-shaped part 13*b* having its outer edge connected to the lower end of the cylindrical part 13*a*. The space inside the first jacket 13 is filled with helium gas.

The second-stage cooling section 14 is annular and is mounted around the periphery of the tip (second end) of the second cylindrical part 2*c*. A disc-shaped second thermal coupling member 15 is in contact with the second-stage cooling section 14 for thermal conduction. A second thermal conduction plate 16 is in contact with the second-stage cooling section 14, and a second flexible conductive member 17 is in contact with the second heat shield 5. The second thermal coupling member 15, the second thermal conduction plate 16 and the second flexible conductive member 17 together provide thermal coupling between the second-stage cooling section 14 with the second heat shield 5. The second flexible conductive member 17 absorbs any thermal contraction due to temperature change.

A second jacket 18 has a cylindrical part 18*a* which is provided to surround the second cooling section 14 and the second thermal connecting member 15. The upper end of the cylindrical part 18*a* is connected to the inner edge of the flange-shaped part 13*b*. The second jacket 13 also has a disc-shaped part 18*b* having its peripheral edge connected to the lower end of the cylindrical part 18*a*. The space inside the second jacket 18 is filled with helium gas.

A compressor unit 19 supplies compressed helium gas to the refrigerator 2, and supplies electric power to a valve driving motor, not shown, built in the refrigerator 2.

The operation will now be described. The amount of heat infiltrating into the cryogen container 1 varies depending on the tempertures of the first and second heat shields 4 and 5. As the temperatures of the heat shields 4 and 5 are lower, the infiltration of heat is reduced, so is the consumption of the liquid helium cooling the coils of the superconducting magnet, or any other cooled object, accommodated in the cryogen container 1. Accordingly, the first and second heat shields 4 and 5 are cooled by the use of the refrigerator 2 to reduce the consumption of the liquid helium.

When the refrigerator 2 is made to operate, the first-stage cooling section 9 and the second-stage cooling section 14 are cooled to about 80 K and about 20 K, respectively and as a result, the first heat shield 4 is cooled via the first thermal coupling section 10, the flange-shaped part 13*b*, the first thermal conduction plate 11 and the first flexible conductive member 12, and the second heat shield 5 is cooled via the second thermal coupling section 15, the disc-shaped part 18*b*, the second thermal conduction plate 16 and the second flexible conductive member 17.

The refrigerator 2 (including the first and the second cylindrical parts 2*b* and 2*c*) sometimes needs to be removed for replacement or repair. For the removable, the first-stage cooling section 9 and the second-stage cooling section 14 are formed so that they can be separated from the first thermal coupling section 10 and the second thermal coupling section 15, respectively.

A problem associated with the above-described prior-art cryostat is that the contact pressure between the thermal coupling section 10 and 15 and the cooling sections 9 and 14 can vary depending on the manufacturing dimensional variations (within tolerances) and the thermal contraction of the cooling sections 9 and 14 and the jackets 13 and 18 surrounding the cooling sections 9 and 14, and the thermal conductivity at the contacting surfaces can be lowered.

Another problem associated with the prior-art cryostat is that when it is tiled by 90° from the state shown in FIG. 1, due to helium gas convection, heat is conducted from the part closer to the outside of the vacuum container 6 to the part closer to the cryogen container 1, and cooling effect is degraded.

A further problem is that as the refrigerator 2 is operated, the pressure inside the first jacket 13 becomes negative (lower than the atmospheric pressure), and air may leak into the space inside the first jacket 13, through a sealing part, not specifically indicated, and may be frozen in the space inside the jacket 13.

A yet further problem is that when the refrigerator is removed for replacement or for repair, it is necessary to cover the mounting part at which the refrigerator 2 is mounted with a gas bag, not shown, and fill the gas bag with helium gas, before actually removing the refrigerator. Such work is time-consuming.

SUMMARY OF THE INVENTION

The invention has been made in view of the above, and its object is to provide a cryostat in which the cooled part can be efficiently cooled.

Another object of the invention is to provide a cryostat in which the space inside the jacket can be maintained at a positive pressure even when the refrigerator is operated and the leakage of air into the jacket can thereby be prevented.

A further object of the invention is to provide a cryostat in which the refrigerator can be removed for replacement or repair with ease.

A cryostat according one aspect of the invention comprises:

a vacuum container (6);

a refrigerator (2) having an elongated part (**2*b*, 2*c*) extending in said vacuum container and having a cooling section (36, 37**);

a cooled member (4, 5) disposed in said vacuum container and cooled by said cooling section;

a thermal coupling member (21, 27) disposed in said vacuum container and thermally coupling the cooling section (36, 37) with the cooled member (4, 5);

wherein said thermal coupling member comprises:

a first thermal contactor (22, 28) thermally coupled to the cooling section, and a second thermal contactor (29) thermally coupled to the cooled member, said first and second contactors having mating surfaces mating with each other;

said mating surfaces of said first and second contactors being inclined with respect to the direction in which said elongated part extends, and at least one of said first and second contactors being mounted so that it is movable in the direction in which said elongated part extends, relative to the other one of said first and second contactors;

a resilient member pressing said at least one of the contactors against the other one of said first and second contactors in said direction in which said elongated part extends;

whereby the contact pressure at the mating surfaces is kept substantially constant regardless of the manufacturing dimensional variation or thermal contraction.

A cryostat according to another aspect of the invention comprises:

a vacuum container (6);

a refrigerator (2) having an elongated part extending in said vacuum container and having a cooling section (36, 37);

a cooled member (4, 5) disposed in said vacuum container and cooled by the cooling section (4, 5) of the refrigerator (2);

a thermal coupling member (21, 27) disposed in said vacuum container and thermally coupling the cooling section (36, 37) with the cooled member (4, 5);

a jacket (13) surrounding the cooling section and the thermal coupling member and filled with a cryogen gas;

wherein the interior of the jacket is partitioned by one or more partitions into parts arranged in the direction in which said elongated part extends.

A cryostat according to a further aspect of the invention comprises:

a vacuum container (6):

a cryogen container (1) disposed within said vacuum container (6) and containing a liquid cryogen;

a space (41) in which a cryogen gas resulting from evaporation of the liquid cryogen is staying;

a refrigerator (2) having an elongated part (**2*b*) extending in said vacuum container (6) and having a cooling section (36**);

a cooled part (4) cooled by the cooling section of the refrigerator (2);

a jacket (13) surrounding said elongated part (**2*b***);

characterized by further comprising:

a communication tube (51) connecting a space (42) within the jacket (13) with said space (41) in which the cryogen gas is staying.

DETAILED DESCRIPTION OF THE PREFERRED EMBODIMENTS

An embodiment of the invention will now be described with reference to FIG. 2 and FIG. 2A.

Figure 1:
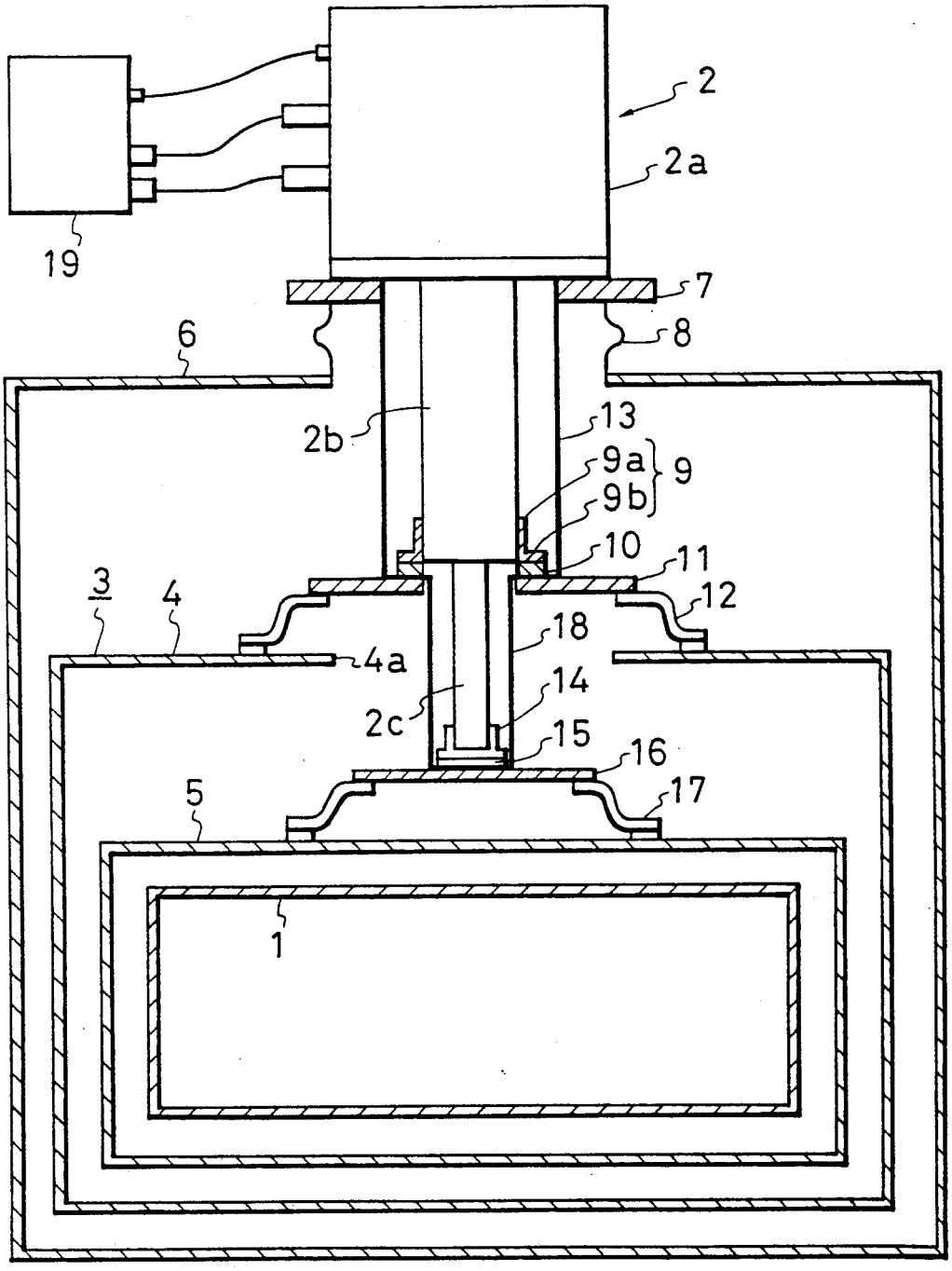
FIG. 1 PRIOR ART
FIG. 1 is an elevational view, partially in section, of a cryostat in the prior art.

Members identical or similar to those in the prior-art example of FIG. 1 are denoted by identical reference numerals and their description is omitted.

The first-stage cooling section 9 of FIG. 1 is replaced by a first-stage cooling section 36, which comprises a collar part 36*a* having its inner periphery in contact with and fixed to the outer cylindrical surface of the first cylindrical part 2*b* and having a lower end in alignment with the second end of the first cylindrical part 2*b*, and a flange part 36*b* having its inner edge connected to the upper end of the collar part 36*a*.

In place of the first thermal coupling member 10 of FIG. 1, there is provided a first thermal coupling member 21 for thermally coupling the first-stage cooling section 36 with a first conduction member 11, and thereby with the first heat shield 4. The first conduction member 11 of this embodiment comprises a flange-shaped part 11*a* and a cylindrical part 11*b* having its lower end connected to the flange-shaped part 11*a* and having its inner surface in contact with the outer surface of the cylindrical part 13*a* of the jacket 13. The cylindrical part 11*b* extends upward up to a height or level at or above the upper edge of the outer cylindrical surface of the second contactor 23, so that the entire outer cylindrical surface of the second contactor 23 is thermally coupled with the inner surface of the cylindrical part 11*b* confronting the outer cylindrical surface of the second contactor 23 via the cylindrical part 13*a* of the first jacket 13.

The first thermal coupling member 21 comprises a first contactor 22 and a second contactor 23 mating with each other, as well as conducting rings 24.

The first contactor 22 is mounted, at its a cylindrical inner surface, to the cylindrical surface of the collar part 36*a* in such a way that the first contactor 22 is movable along the axis 2*x* of the first cylindrical part 2*b*, i.e., along the direction in which the first cylindrical part extends. The first contactor 22 has a conical outer surface facing and tapered downward, i.e., toward the second end of the cylindrical part 2*b*, i.e., in the direction away from the main block 2*a*.

The second contactor 23 is fixed, at its outer cylindrical surface, near the lower end of the cylindrical part 13*a* of the first jacket 13, and has an inner surface of a shape of truncated cone tapered downward so that the conical inner surface faces upward, thereby to conform to and mate with the conical outer surface of the first contactor 22.

The conducting rings 24 are disposed to extend around the conical outer surface of the first contactor 22, and are disposed and clamped between the conical surfaces of the first and the second contactors 22 and 23. Two conducting rings 24 are shown to be provided, but any other number of conducting rings may be provided instead. The conducting rings 24 are made of a material which has a good thermal conductivity, and which is soft, and which is has a round cross section. A suitable material is indium.

A plurality of, e.g., eight, spiral springs 25 are disposed around the cylindrical part 2*b*, being spaced at equal distances. The spiral springs are oriented so that their axes are in a plane orthogonal to the axis 2*x* of the first cylindrical part 2*b*. Each of the spiral springs is disposed between and fixed by screws 25*a* and 25*b* to the lower surface of the flange part 36*b* of the first-stage cooling section 36 and the first contactor 22. As a result, the spiral springs 25 press the first contactor 22 downward, as seen in FIG. 2, and the first contactor 22, which is movable relative to the cylindrical part 2*b*, is pressed against the second contactor 23, via the conducting rings 24. The spiral springs 25 are thermally conductive to transmit heat from the first contactor 22 to the first-stage cooling section 36.

Partitions 26*a* and 26*b* are provided to divide the space 42 inside the first jacket 13 into three parts 42*a*, 42*b* and 42*c* arranged in the direction of the axis 2*x* of the cylindrical member 2*b*. The partitions 26*a* and 26*b* are made of a heat-insulating material, such as a foam material. The partitions 26*a* and 26*b* are flange-shaped, having inner edges fixed to the first cylindrical part 2*b*, and having their outer edges being in slidable contact with or slightly separated from the inner surface of the first jacket 13.

In place of the second-stage cooling section 14 of the prior-art example of FIG. 1, a second-stage cooling section 37 is provided, which is disc-shaped, and is attached to the second end of the second cylindrical part 2*c*.

The second thermal coupling member 15 of FIG. 1 is replaced by a second thermal coupling member 27. The second thermal coupling member 27 is for thermally coupling the second-stage cooling section 37 with a second conduction member 16, thereby with the second heat shield 5. The second conduction member 16 of this embodiment comprises a disc-shaped part 16*a* and a cylindrical part 16*b* having its lower end connected to the disc-shaped part 16*a* and having its inner surface in contact with the outer surface of the cylindrical part 18*a* of the second jacket 18. The cylindrical part 16*b* extends upward to a height or level at or above the upper edge of the outer cylindrical surface of the second contactor 29, so that the entire outer cylindrical surface of the second contactor 29 is thermally coupled with the inner surface of the cylindrical part 16*b* confronting the outer cylindrical surface of the second contactor 29 via the cylindrical part 18*a* of the second jacket 18.

The second thermal coupling member 27 is disposed under the second end of the second-stage cooling section 37, and comprises a first contactor 28 and a second contactor 29 mating with each other, as well as conducting rings 30.

The first contactor 27 has a conical outer surface facing and tapered downward, i.e., in the direction away from the main block 2*a*.

The second contactor 29 is fixed, at its outer cylindrical surface, to the lower end of the cylindrical part 18*a* of the second jacket 18, and has a conical inner surface tapered downward, i.e., in the direction away from the main block 2*a*, so that the conical inner surface faces upward, thereby to conform to and mate with the conical outer surface of the first contactor 28.

The conducting rings 30, which are similar to the conducting rings 24, are disposed to extend around the conical outer surface of the first contactor 28, and are dispoosed and clamped between the conical surfaces of the first and the second contactors 28 and 29. Two conducting rings 30 are shown to be provided, but any other number of conducting rings may be provided instead.

A flexible thermal conductor 31 is provided between the second-stage cooling section 14 and the first contactor 28 and thermally couples the second-stage cooling section 14 with the first contactor 28. The flexible thermal conductor 31 is formed of copper braid, formed by braiding thin copper filaments, and is fixed by screws 31*a* and 31*b* to the second-stage cooling section 37 and to the first contactor 28.

A resilient member 32 formed of a stack of coned-disc-springs 32 is disposed and is provided to be compressed between the second-stage cooling section 37 and the first contactor 28. Being compressed between them, the resilient member 32 presses the first contactor 28 in the direction of the axis 2*x* of the second cylindrical part 2*c*, i.e., in the direction in which the second cylindrical part 2*c* extends, and downward, to apply a contact pressure between the first and the second contactors 28 and 29.

Second partitions 33*a* and 33*b*, similar to the first partitions 26, are provided to divide the space 43 inside the second jacket 18 into three parts 43*a*, 43*b* and 43*c* arranged in the direction of the axis 2*x* of the cylindrical member 2*c*. Like the partitions 26*a* and 26*b*, the partitions 33*a* and 33*b* are made of a heat-insulating material, such as a foam material. The partitions 33*a* and 33*b* are flange-shaped, having inner edges fixed to the second cylindrical part 2*c*, and having their outer edges being in slidable contact with or slightly separated from the inner surface of the second jacket 18.

Figure 3:
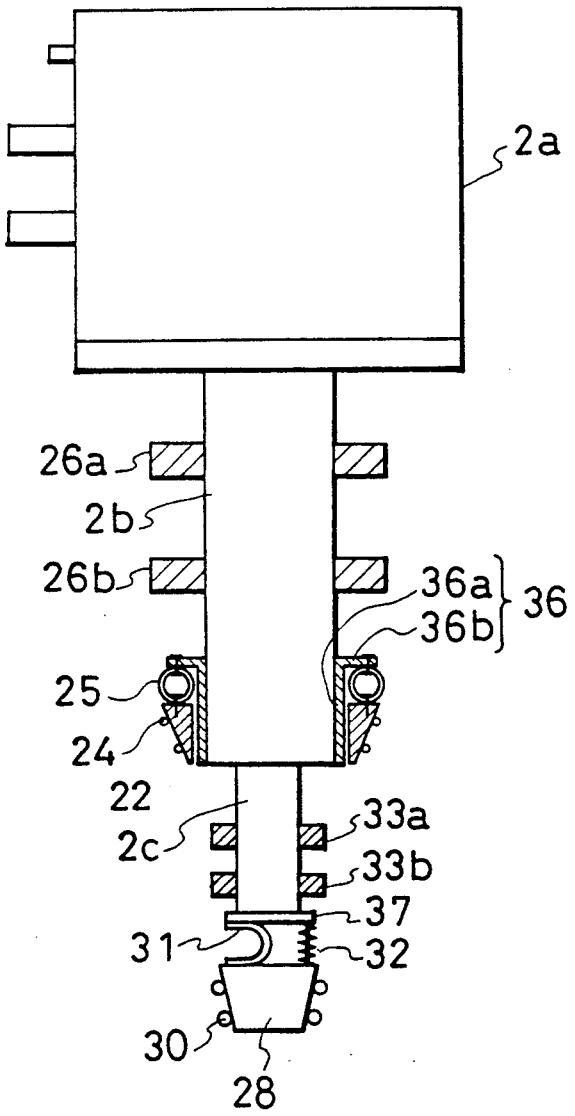
FIG. 3 is an elevational view of a refrigerator as it is removed from the rest of the cryostat.
Figure 4:
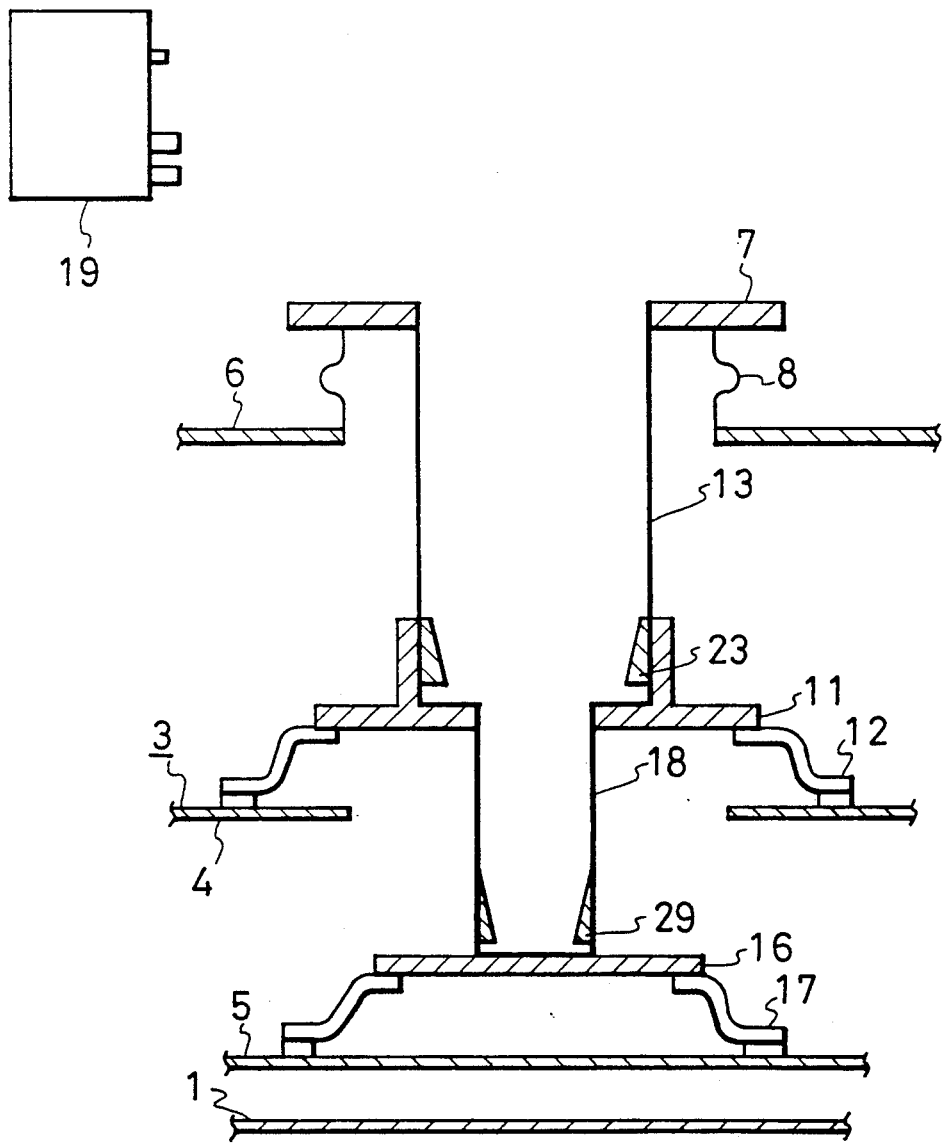
FIG. 4 is an elevational view of the cryostat of FIG. 2, with the refrigerator having been removed.

For assembly of the cryostat described above, the first-stage and the second-stage cooling sections 36 and 37, the contactors 22 and 38, the partitions 26*a*, 26*b*, 33*a* and 33*b*, and the resilient conducting members 25, the flexible thermal conductor 31, the resilient member 32 and the conducting rings 24 and 30 are mounted to the refrigerator 2, as shown in FIG. 3. On the other hand, the second contactors 23 and 29 are mounted to the first and the second jackets 13 and 18, respectively, as shown in FIG. 4. The refrigerator 2 with the members mounted thereto as described above are inserted, into the first and the second jackets 13 and 18.

For removing the refrigerator 2, for replacement or repair, the refrigerator 2 with the members mounted thereto as described above is pulled out, separation being made between the conducting rings 24 and the second contactor 23 of the first thermal coupling member 21, and between the conducting rings 30 and the second contactor 29 of the second thermal coupling member 27.

At the first thermal coupling member 21, the resilient thermal conducting member 25 presses the first contactor 22 downward. As the conical outer surface of the first contactor 22 is facing downward, and confronting with the upward facing conical inner surface of the second contactor 23, the first contactor 22 is pressed, via the conducting rings 24, against the second contactor 23. Accordingly, even if there are manufacturing dimensional variations or thermal contraction, the contact pressure between the first and the second contactors 22 and 23, via the conducting rings 24, is kept substantially constant, and increase in the degradation in heat conductivity is therefore avoided. Heat is conducted from the first heat shield 4, the first flexible conductor 12, the flange-shaped part 11*a* of the first thermal conduction member 11, the cylindrical part 11*b* of the first thermal conduction member 11, the cylindrical part 13*a* of the first jacket 13, the second contactor 23, the conducting rings 24, the first conductor 22, the resilient conducting member 25 and the first-stage cooling section 9.

At the second thermal coupling member, the resilient thermal conductor 32 presses the first contactor 28 downward. As the conical outer surface of the first contactor 28 is facing downward, and confronting with the upward facing conical inner surface of the second contactor 29, the first contactor 23 is pressed, via the conducting rings 30, against the second contactor 29. Accordingly, even if there are manufacturing dimensional variations or thermal contraction, the contact pressure between the first and the second contactors 28 and 29, via the conducting rings 30, is kept substantially constant, and increase in the degradation in heat conductivity is thereby avoided. Heat is conducted from the second heat shield 5, the second flexible conductor 17, the disc-shaped part 16*a* of the second thermal conduction member 16, the cylindrical part 16*a* of the second thermal conduction member 16, the cylindrical part 18*a* of the second jacket 18, the second contactor 29, the conducting rings 30, the first contactor 28, the resilient conductor 31 and the second-stage cooling section 14.

With the provision of the partitions 26*a*, 26*b*, 33*a* and 33*b*, convection of the gas within the jackets 13 and 18 is limited, and even if the cryostat is used in a position 90° tilted, the flow of the heat into the cryogen container is reduced.

Figure 5:
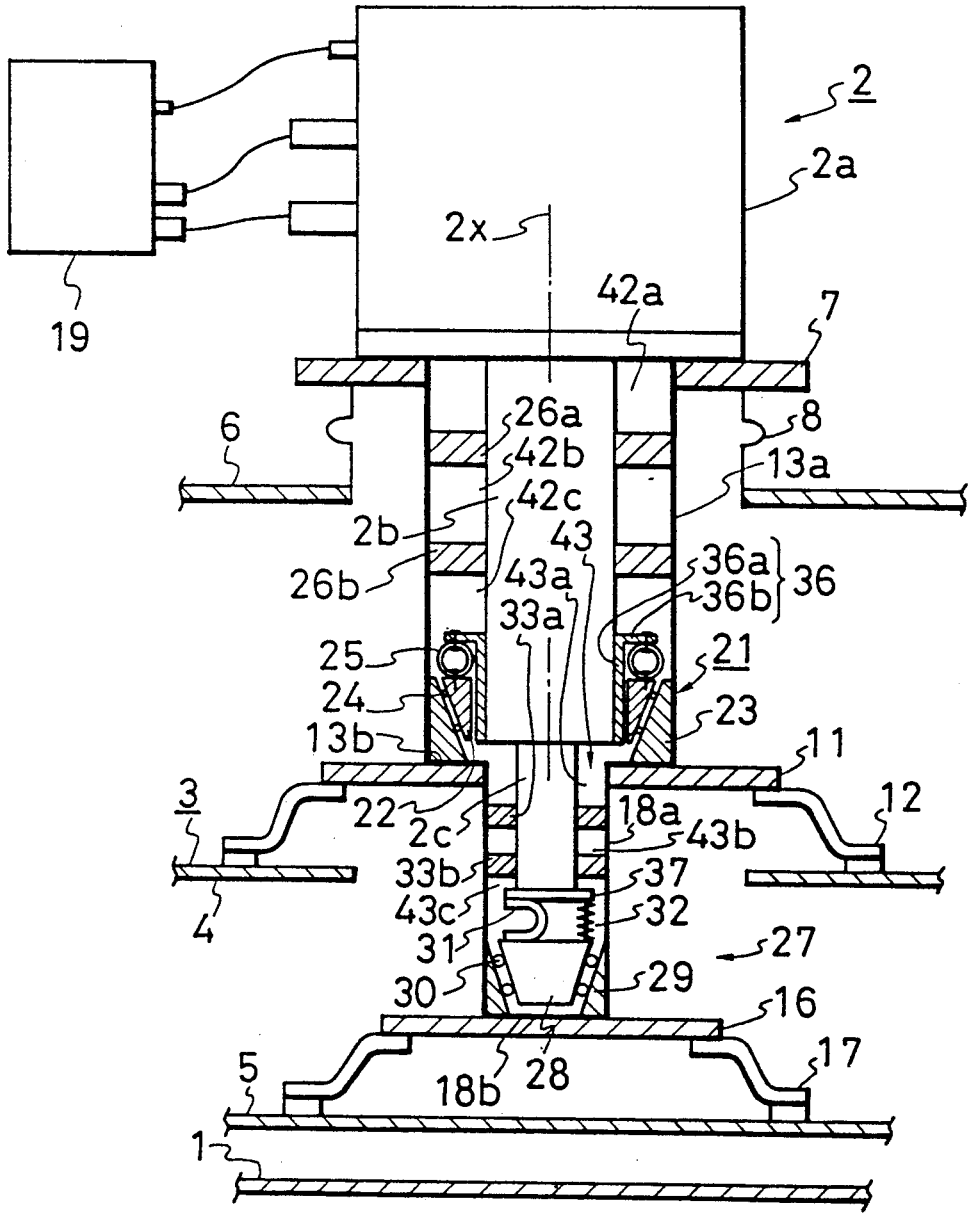
FIG. 5 is an elevational view, partially in section, of a modification of the embodiment of FIG. 2.

In the embodiment described, the second contactors 23 and 29 of the first and second thermal coupling members 21 and 27 are mounted to the cylindrical parts 13*a* and 13*b* of the jackets 13 and 18, but they may alternatively be mounted to the flange-shaped part 13*b* and the disc-shaped part 18*b* of the first and second conducting members 11 and 16, as shown in FIG. 5. An advantage of the modification of FIG. 5 is that the cylindrical parts 11*b* and 16*b* can be eliminated.

Figure 6:
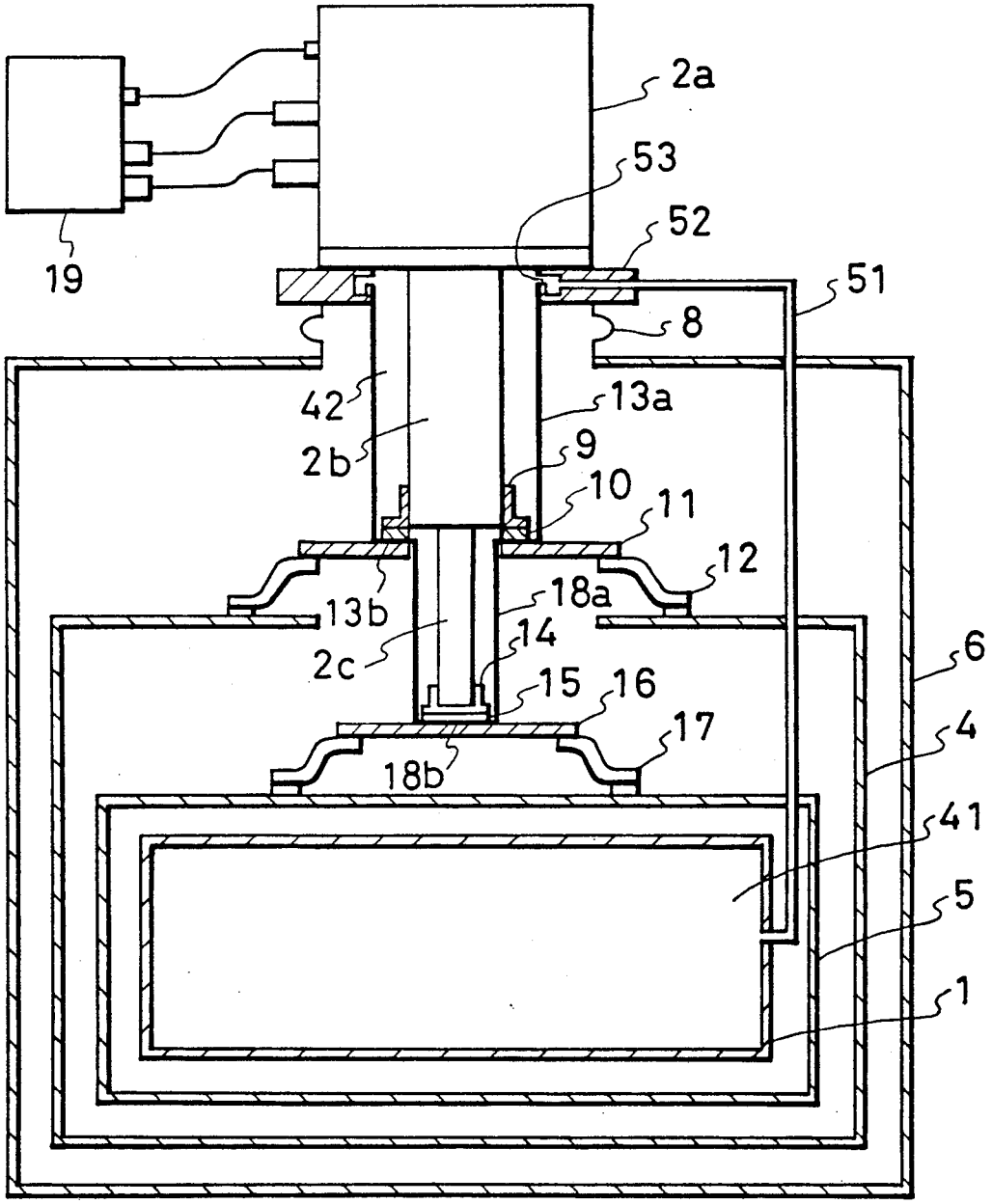
FIG. 6 is an elevational view of a cryostat of another embodiment of the invention.

FIG. 6 shows another embodiment of the invention. Members or parts identical or similar to those in the prior-art example of FIG. 1 are denoted by identical reference numerals and their description is omitted.

Figure 2:
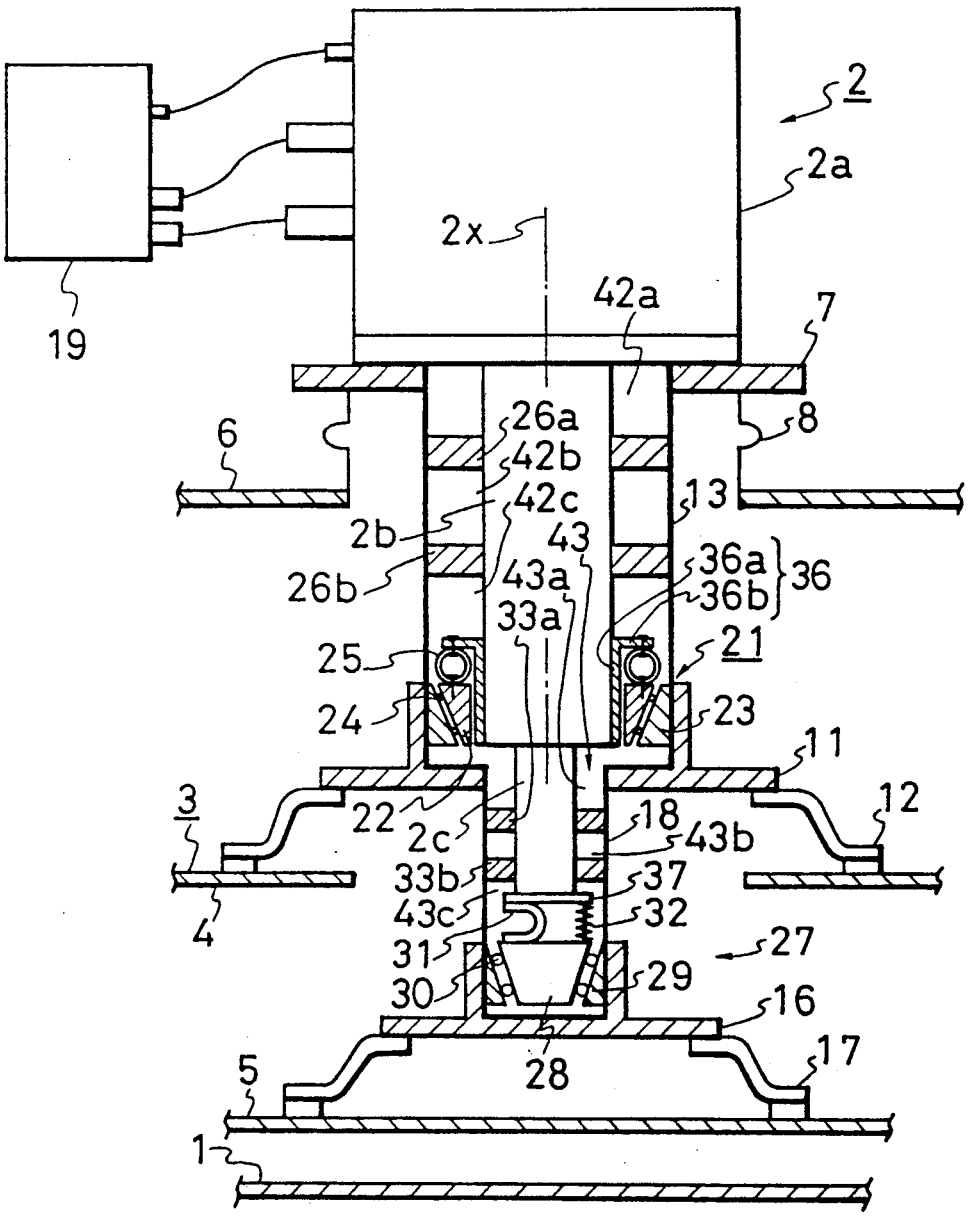
FIG. 2 is an elevational view, partially in section, of a cryostat of an embodiment of the invention.
Figure 2A:
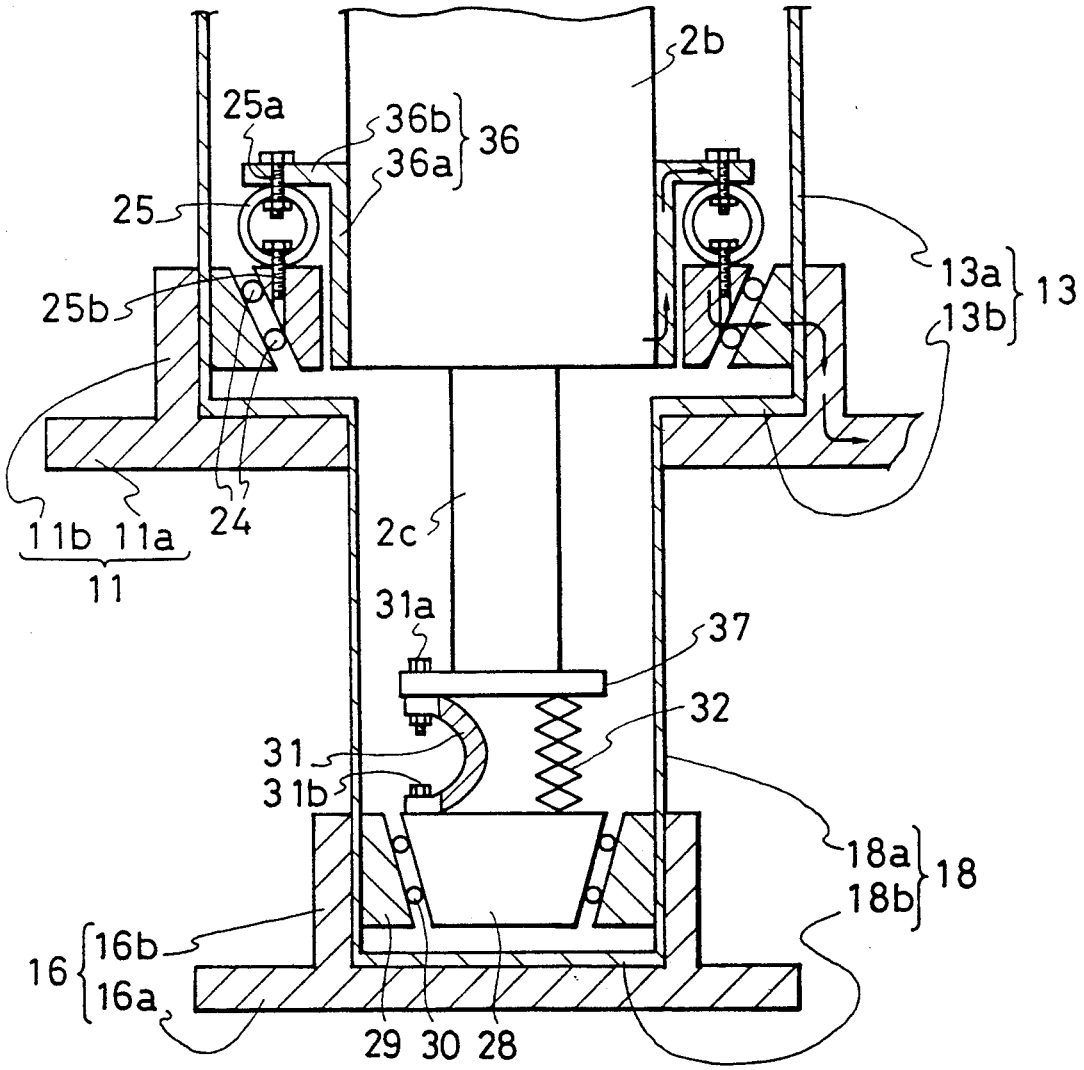
FIG. 2A is an elevational view, in section, showing thermal coupling members in greater detail.

The cryostat of this embodiment is featured by the provision of a communication tube 51 directly connecting a space 42 within the first jacket 13 comprising the cylindrical part 13*a* and the flange-shaped part 13*b*, like the embodiment of FIG. 2, with a space 41 within the cryogen container 1 in which the cryogen gas resulting from evaporation of the liquid cryogen is staying and the pressure is positive.

Preferably, the communication tube 51 connects an end of the space 42 adjacent the main block 2*a* of the refrigerator 2, as illustrated. In the illustrated embodiment, the communication tube 51 is formed of metal, and is connected to the jacket 13 via a mounting flange 52, which serves not only for mounting the communication tube 51 to the jacket 13 but also for mounting the refrigerator 2 to the vacuum container 6, like the flange 7 of FIG. 1. The mounting flange 52 is annular and is disposed at the upper end of the first jacket 13.

The mounting flange 52 has an annular spray section 53 extending around the upper edge of the cylindrical part 13*a* of the first jacket 13. The spray section 53 is for spraying the cryogen gas to form a gas screen sealing the upper end of the space 42 within the first jacket 13 thereby to prevent entry of air when the refrigerator 2 with its cylindrical parts 2*b* and 2*c* is removed and the opening of the communication tube 51 is thereby opened to the atmosphere.

When the refrigerator 2 is operated, the first-stage cooling section 9 is cooled to about 80K and the second-stage cooling section 14 is cooled to about 20K, as in the prior-art example. The space 42 inside the jacket is also cooled to a very low temperature, and the pressure in the space 42 tends to fall. Since the space 42 is communicated with the communication tube 51 with the cryogen container 1, helium gas is supplied from the space 41 through the communication tube 51 to the space 42, so the pressure in the space 42 is prevented from becoming negative, and is maintained positive. Accordingly, leakage of air into the space 42 from the atmosphere is prevented, and freezing of the air is also prevented.

Figure 7:
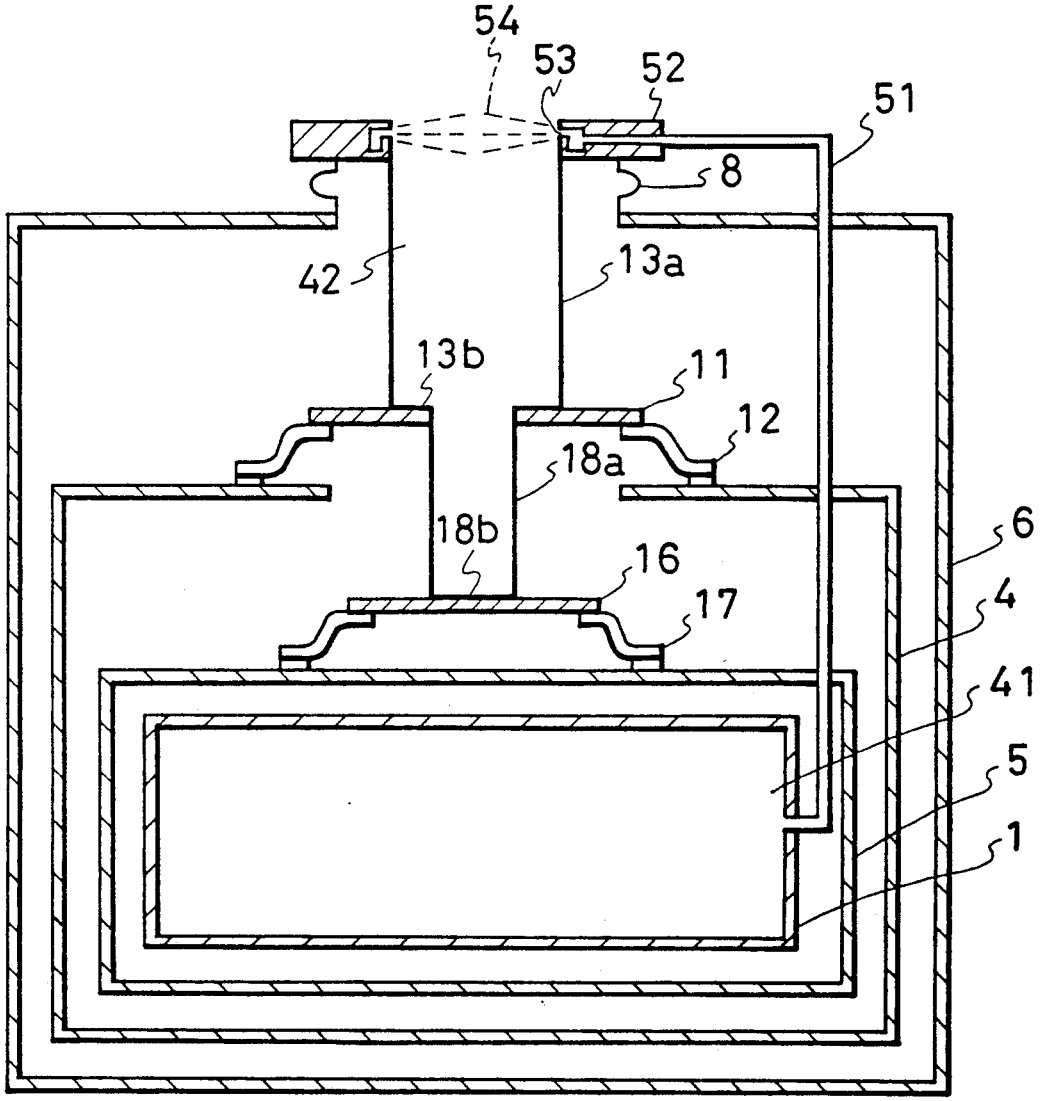
FIG. 7 is an elevational view of the cryostat of FIG. 6, with the refrigerator having been removed.

As illustrated in FIG. 7, when the refrigerator 2 is removed for replacement or repair, the helium gas is sprayed out of the spray section 53 within the mounting flange 53, and a gas screen 54 is formed. By virtue of the gas screen 54, entry of air into the space 42 is prevented.

It is therefore unnecessary to use a gas bag or like tools for preventing the entry of air into the space 42 at the time of removable of the refrigerator 2.

In the embodiment of FIG. 6 and FIG. 7, the space in which the cryogen gas is staying is within the cryogen container 1, but such a space may be in a separate container, such as a separate helium gas reservoir provided to collect the evaporated helium gas resulting from evaporation of the liquid helium in the cryogen container 1.

The communication tube 1 may be in the form different from that illustrated, may extend along a path different from that illustrated, and may be formed of a material other than metal. There may be more than one communication tubes 51.

The refrigerator 2 in the illustrated embodiments is of a two-stage type, but the number of the stages may be one or more than two.

In the embodiments described, the cryogen is liquid helium, but any other cryogen, e.g., nitrogen, may be used instead.

The invention is applicable to cryostat for use in apparatus other than NMR imaging apparatus.

What is claimed is:

1. A cryostat comprising:

a vacuum container (6);

a refrigerator (2) having an elongated part (2*b*, 2*c*) extending in said vacuum container and having a cooling section (36, 37);

a cooled member (4, 5) disposed in said vacuum container and cooled by said cooling section;

a thermal coupling member (21, 27) disposed in said vacuum container and thermally coupling the cooling section (36, 37) with the cooled member (4, 5);

wherein said thermal coupling member comprises:

a first thermal contactor (22, 28) thermally coupled to the cooling section, and a second thermal contactor (23, 29) thermally coupled to the cooled member, said first and second contactors having mating surfaces mating with each other;

said mating surfaces of said first and second contactors being inclined with respect to the direction in which said elongated part extends, and at least one of said first and second contactors being mounted so that it is movable in the direction in which said elongated part extends, relative to the other one of said first and second contactors;

a resilient member pressing said at least one of the contactors against the other one of said first and second contactors in said direction in which said elongated part extends;

whereby the contact pressure at the mating surfaces is kept substantially constant regardless of the manufacturing dimensional variation or thermal contraction.

2. The cryostat of claim 1, wherein said elongated part is cylindrical, and said mating surface of said first contactor is a conical outer surface and said mating surface of said second contactor has a conical inner surface, and said conical outer surface and said conical inner surface are tapered in the same direction.

3. The cryostat of claim 2, wherein said refrigerator has a part (2*a*) situated outside said vacuum container, and said mating surfaces are tapered in a first direction away from said part of the refrigerator outside the vacuum container.

4. The cryostat of claim 2, wherein said first contactor is substantially annular and has its cylindrical inner surface in contact with the cylindrical surface of the cylindrical part, and is movably mounted to the cylindrical part.

5. The cryostat of claim 4, wherein said resilient member presses said first contactor in said first direction.

6. The cryostat of claim 5, wherein said resilient member comprises spiral springs disposed around the cylindrical part and fixed to the cooling section, and pressing the first contactor in said first direction.

7. The cryostat of claim 6, wherein said spiral springs are heat conductive.

8. The cryostat of claim 6, wherein one or more conducting rings extend around the first contactor and are disposed between the first and second contactors.

9. The cryostat of claim 8, wherein said rings have a round cross section.

10. The cryostat of claim 2, wherein the cooling section is substantially disc-shaped and is in contact with the tip of the cylindrical member, and said first contactor is truncated-cone-shaped having a conical, outer surface, and is movably mounted to the cooling section.

11. The cryostat of claim 10, wherein the resilient member comprises a stack of coned-disc springs fixed to the tip of the cylindrical member and pressing said first end surface of said first contactor.

12. The cryostat of claim 10, further comprising a flexible heat conducting member thermally coupling said cooling section and said first contactor.

13. The cryostat of claim 10, wherein one or more conducting rings extend around the first contactor, and are disposed between the first and the second contactors.

14. The cryostat of claim 13, wherein said rings have a round cross section.

15. The cryostat of claim 1, wherein one or more conducting rings extend around the first contactor and are disposed between the first and the second contactors.

16. The cryostat of claim 15, wherein said rings have a round cross section.

17. A cryostat, comprising:

a) a vacuum container (6);

b) a refrigerator (2) having an elongated cylindrical member extending into said vacuum container, c) a cooling element (36, 37) coupled to said cylindrical member;

d) a cooled member (4, 5) disposed in said vacuum container;

e) a thermal coupling member (21, 27) disposed in said vacuum container and thermally coupling the cooling element with the cooled member (4, 5); and f) cylindrical jacket means (13, 18) surrounding the cylindrical member, the cooling element and the thermal coupling member, and filled with a cryogen gas;

g) wherein an interior space (42, 43) of the jacket means is partitioned into separate chambers by at least one flange (26, 33) extending between said cylindrical member and said jacket means.

18. The cryostat of claim 17, wherein:

a) the cylindrical member comprises a first section (2*b*) and a second, smaller diameter section (2*c*), b) there are a plurality of cooling elements individually coupled to lower ends of the first and second sections, and c) the jacket means comprises first (13) and second (18) jackets individually surrounding the first and second sections.

19. The cryostat of claim 18, wherein there are a plurality of axially spaced, heat insulating flanges extending between the first and second sections and the first and second jackets, and the cylindrical member is heat conducting.

20. The cryostat of claim 19, wherein said flanges are configured as annular discs, and are fixed at inner edges thereof to outer surfaces of the first and second sections.

* * * * *